US005584576A

United States Patent [19]

Wei Hong

[11] Patent Number: 5,584,576

[45] Date of Patent: Dec. 17, 1996

[54] CLAMPING AND CONNECTING STRUCTURE FOR TRACK LIGHTS

[76] Inventor: Shen Wei Hong, 6F, No. 416, Sec. 4, Jen Ai Road, Taipei, Taiwan

[21] Appl. No.: 562,889

[22] Filed: Nov. 27, 1995

[51] Int. Cl.[6] ..... F21V 21/34

[52] U.S. Cl. ..... 362/396; 362/147; 362/404

[58] Field of Search ..... 362/147, 226, 362/285, 382, 396, 404, 391; 439/110, 111, 112, 116, 117, 118, 119, 121

[56] References Cited

U.S. PATENT DOCUMENTS

| | | | |
|---|---|---|---|
| 4,768,964 | 9/1988 | Zucchini | 439/121 |
| 5,440,469 | 8/1995 | Gomes | 362/226 |

*Primary Examiner*—Y. Quach
*Attorney, Agent, or Firm*—Browdy and Neimark

[57] ABSTRACT

A clamping and connecting structure for a track light includes a track unit and a clamping unit. The track unit consists of a track with two grooves each of which receives a packing strip accommodating a lead wire. The clamping unit consists of a clamping sleeve with locking holes at both ends, a pair of clamping pieces each having an upper bent guide strip and a lower through hole, a pair of bent connecting pieces each having an upper through hole and a lower through hole, and a connecting sleeve with insert holes in one side. Screws are used to lock the upper through holes of the connecting pieces and the lower through holes of the clamping pieces to the clamping sleeve such that the guide strips are in contact with the lead wires held by the packing strips of the track. Screws are further used to lock the lower through holes of the connecting pieces to the connecting sleeve, the insert holes of which may receive insert means of a lamp. The connecting sleeve may be instead connected to an extension bar unit which may be connected to a lamp or may be further connected to another extension bar unit.

4 Claims, 7 Drawing Sheets

CLAMPING AND CONNECTING STRUCTURE FOR TRACK LIGHTS

BACKGROUND OF THE INVENTION (a) Field of the Invention

The present invention relates generally to a clamping and connecting structure, and more particularly to a clamping and connecting structure for track lights.

(b) Description of the Prior Art

Conventional track light structures have a number of drawbacks, although the lamp may be mounted on the track in a simple manner. With reference to FIG. 1 which shows a prior track light structure, a body 1A is connected to a lamp 11A at a lower side thereof and is provided with a lever 2A having a fastening block 21A. The lever 2A may be turned to cause the fastening block 21A to be located within a track 3A. When the lever 2A is turned to return its original position, the body 1A may be connected to the track 3A. Besides, the lamp 11A may be disposed in the track 3A at any position. However, known structures of the body 1A do not provide an extension bar to permit extension of the lighting fixture. Besides, since the track 3A is generally mounted at a high position, it will be time-consumptive and inconvenient to fix or replace the lamps.

SUMMARY OF THE INVENTION

Accordingly, a primary object of the present invention is to provide a simple clamping and connecting structure for track lights in which the lighting fixture may be extended by means of extension bars.

Another object of the present invention is to provide a clamping and connecting structure for track lights in which a track unit has a couple of grooves each of which accommodates a packing strip for securing a lead wire and a clamping means consists of a couple of clamping pieces locked to a clamping sleeve, each of the clamping pieces having a guide strip in contact with the lead wire, a couple of connecting pieces locked to the clamping pieces and a connecting sleeve with insert holes for connection with a lamp or an extension bar unit.

A further object of the present invention is to provide a clamping and connecting structure for track lights in which a lamp is mounted on a connecting sleeve.

Still another object of the present invention is to provide a clamping and connecting structure for track lights in which a connecting sleeve is connected to an extension bar unit which is connected to another connecting sleeve for mounting of a lamp.

Still a further object of the present invention is to provide a clamping and connecting structure for track lights in which a connecting sleeve is connected to an extension bar unit which is in turn connected to another extension bar unit locked to another connecting sleeve for mounting of a lamp.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 1:
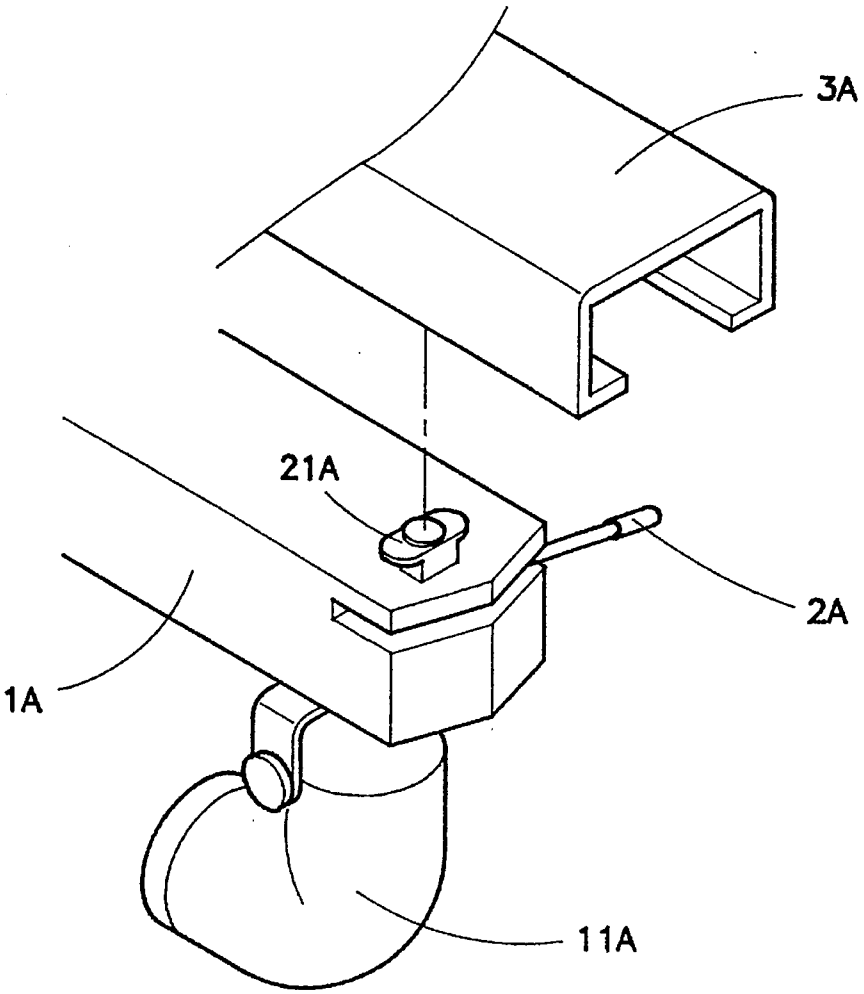
FIG. 1 PRIOR ART
FIG. 1 is a perspective schematic view of the prior art.
Figure 2:
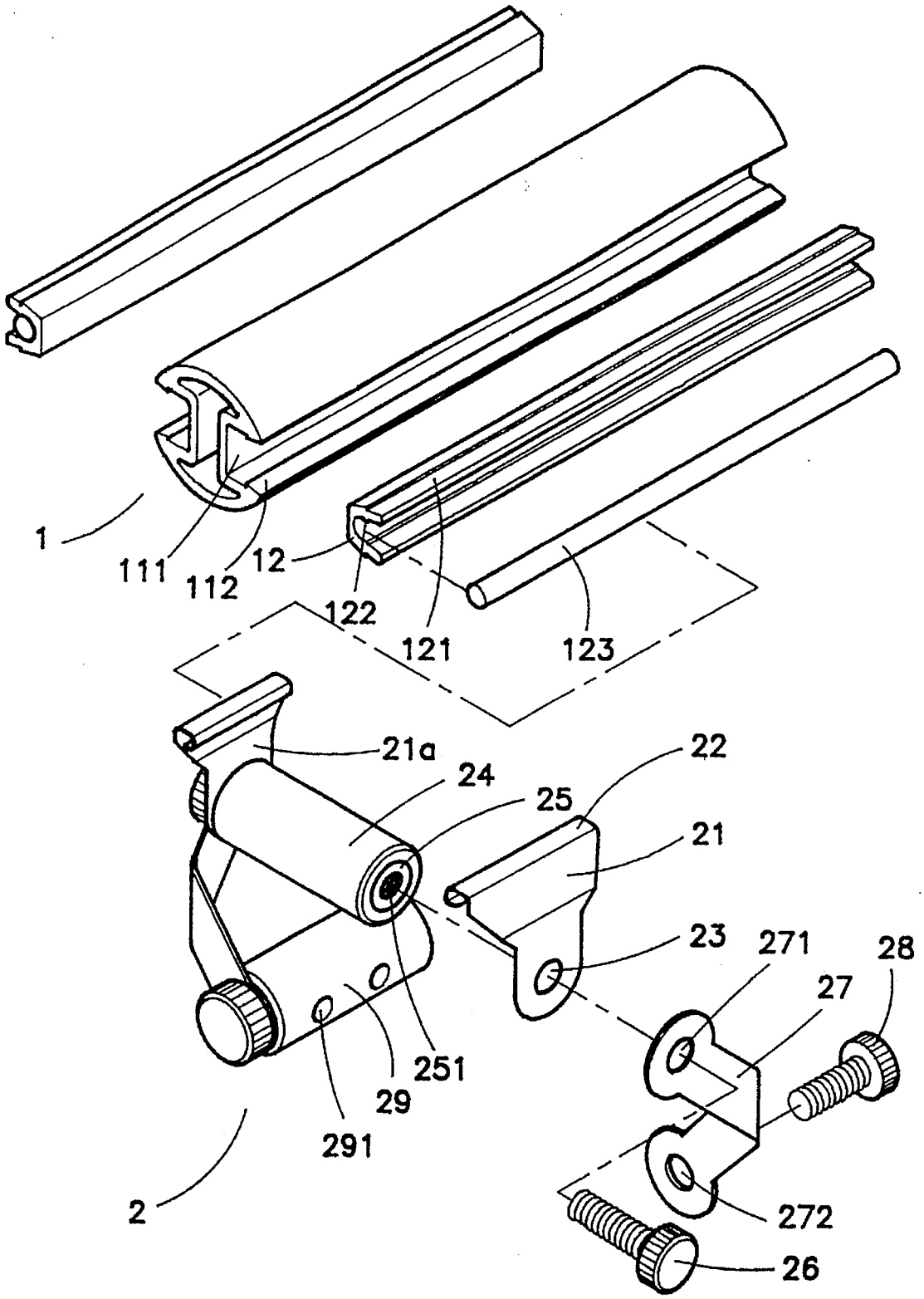
FIG. 2 is a perspective exploded schematic view of the clamping and connecting structure according to the present invention.

With reference to FIG. 2, the invention essentially comprises a track unit 1 and a clamping unit 2. The track unit 1 consists of a track 11 provided with a groove 111 on both sides thereof. Each groove 111 is provided with a raised strip 112 on both outer edges thereof. Each groove 111 receives a packing strip 12, which is provided with a retaining strip 121 at either side thereof for matching the raised strip 112. A retaining recess 122 is defined within the packing strip 12 for holding a lead wire 123. The clamping unit 2 consists of a pair of clamping pieces 21, 21*a*, each having an upper end thereof bending downwardly to form a guide strip 22 and being provided with a through hole 23 in a lower portion thereof, a clamping sleeve 24 having a seat 25 with a lock hole 251 at either end thereof, a pair of bent connecting pieces 27, each having an upper through hole 271 and a lower through hole 272, and a connecting sleeve 29 having a couple of insert holes 291 in one side thereof. A screw 26 is used to pass through the upper through hole 271 and the through hole 23 of the clamping piece 21 into the lock hole 251 of the seat 25. Screws 28 are further used to pass through the lower through holes 272 of the bent connecting pieces 27 into holes at the opposite ends of the connecting sleeve 29 to lock the bent connecting pieces 27 to the connecting sleeve 29.

Figure 3:
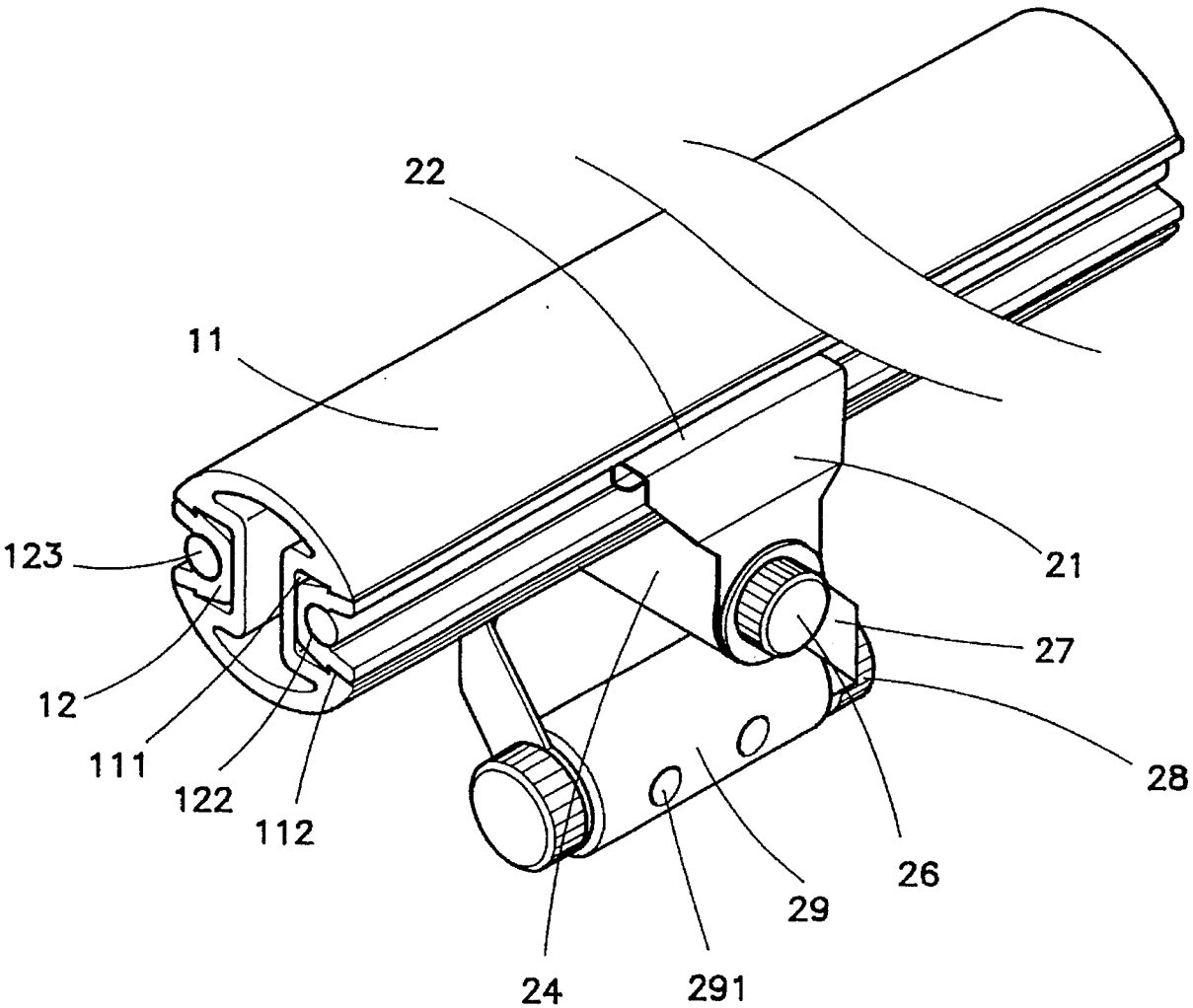
FIG. 3 is a perspective schematic view of the invention in an assembled state.
Figure 4:
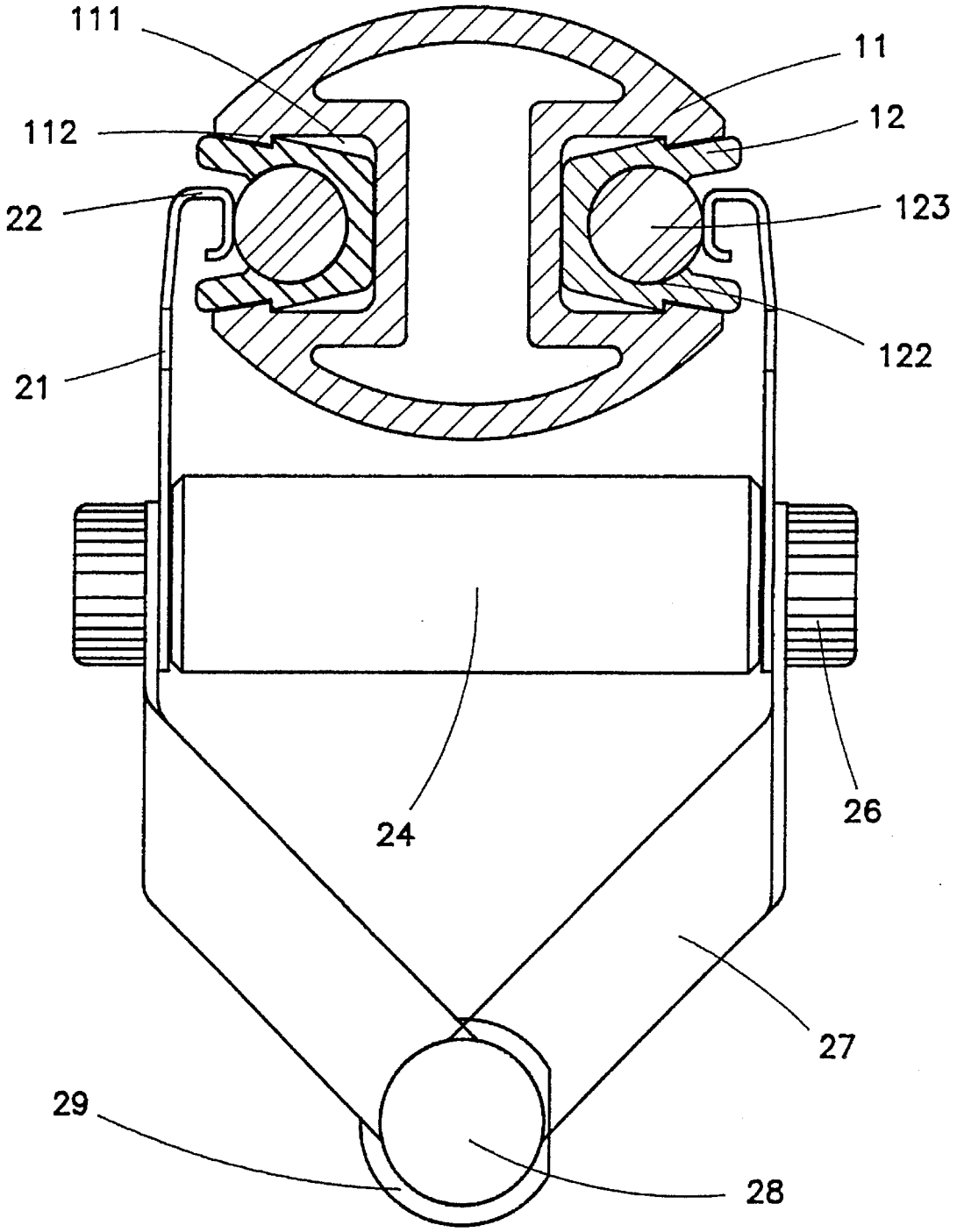
FIG. 4 is a sectional view of the invention.

With further reference to FIGS. 3 and 4, the packing strip 12 is held by the groove 111 of the track 11 of the track unit 1. The packing strip 12 in turn clamps the lead wire 123 within its retaining recess 122. Screws 26 are used to pass through the upper through holes 271 of the bent connecting pieces 27 and the through holes 23 of the clamping pieces 21, 21*a* into the lock holes 251 to lock the bent connecting pieces 27 and the clamping pieces 21, 21*a* to both ends of the clamping sleeve 24, such that each guide strip 22 touches the lead wire 123 held in the retaining recess 122 of the packing strip 12.

Figure 5:
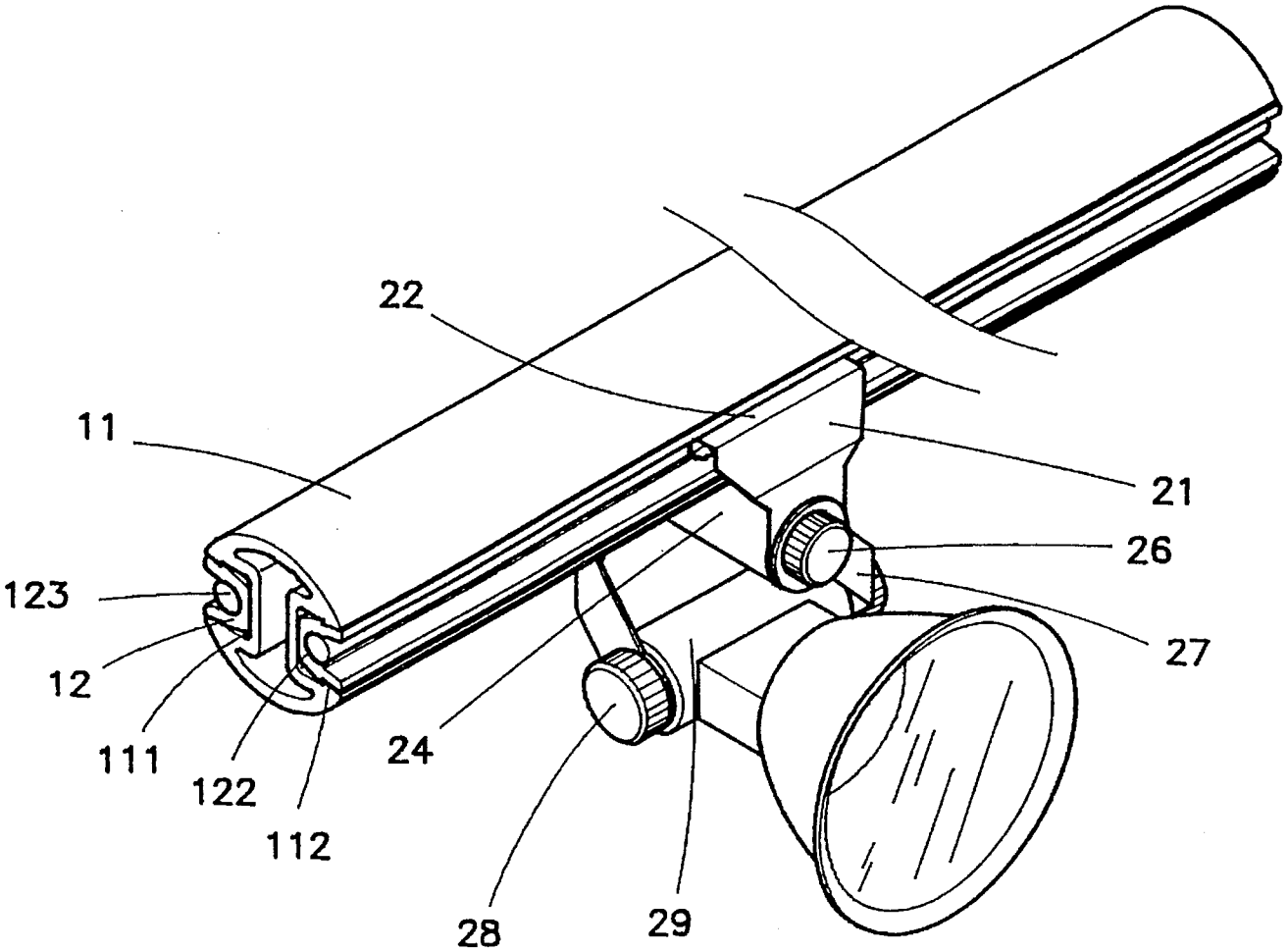
FIG. 5 is a schematic view of a preferred embodiment of the invention.

With reference to FIG. 5, the insert holes 291 of the connecting sleeve 29 may receive insert means of a lamp, and the connecting sleeve 29 is connected via the clamping piece 21 to the track 11.

Figure 6:
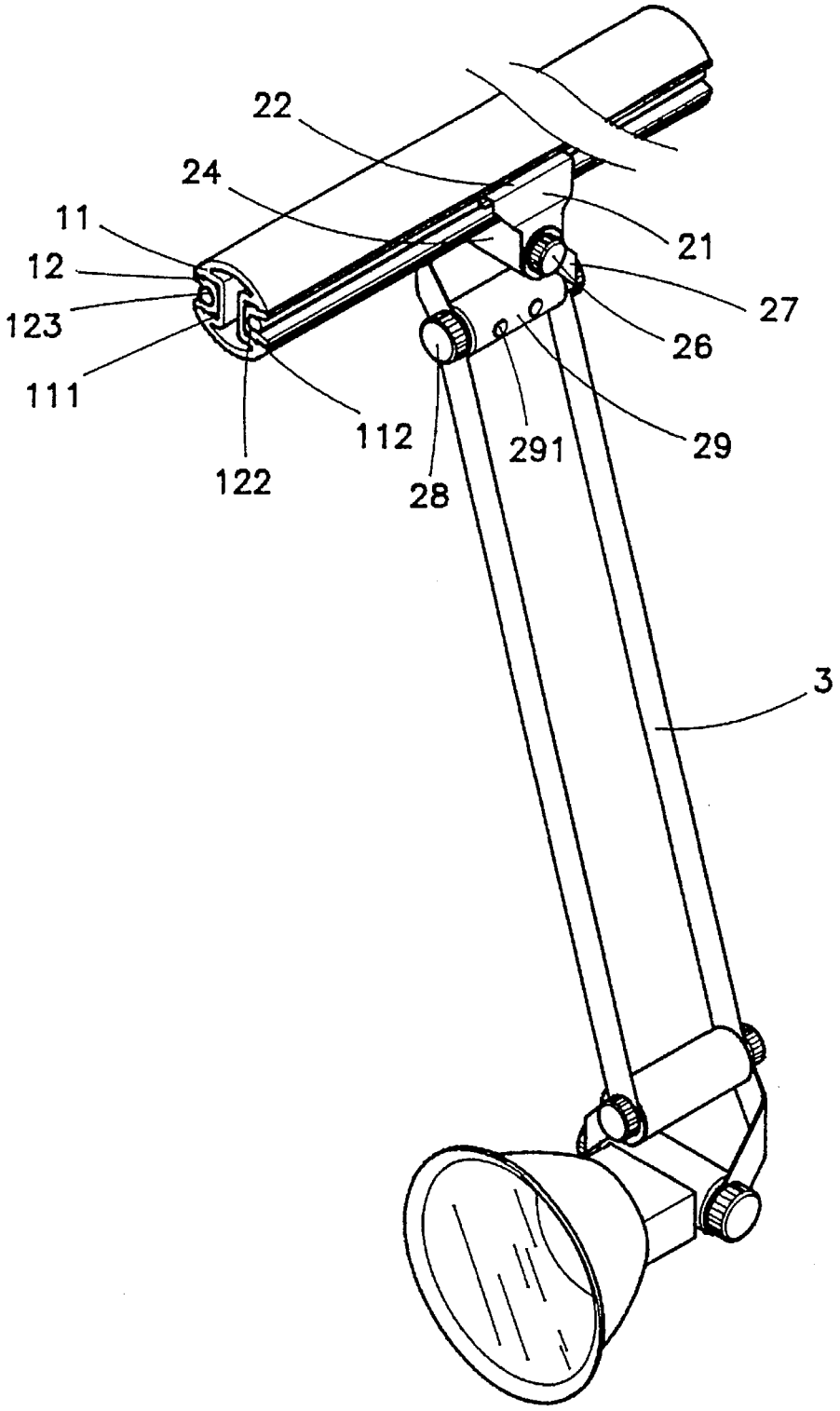
FIG. 6 is a schematic view of another preferred embodiment of the invention.

With further reference to FIG. 6, a couple of extension bars 3 have one of their ends locked to either ends of the connecting sleeve 29 by means of screws 28, with a lamp mounted at the other of their ends through other bent connecting pieces, a connecting sleeve, and a clamping sleeve.

Figure 7:
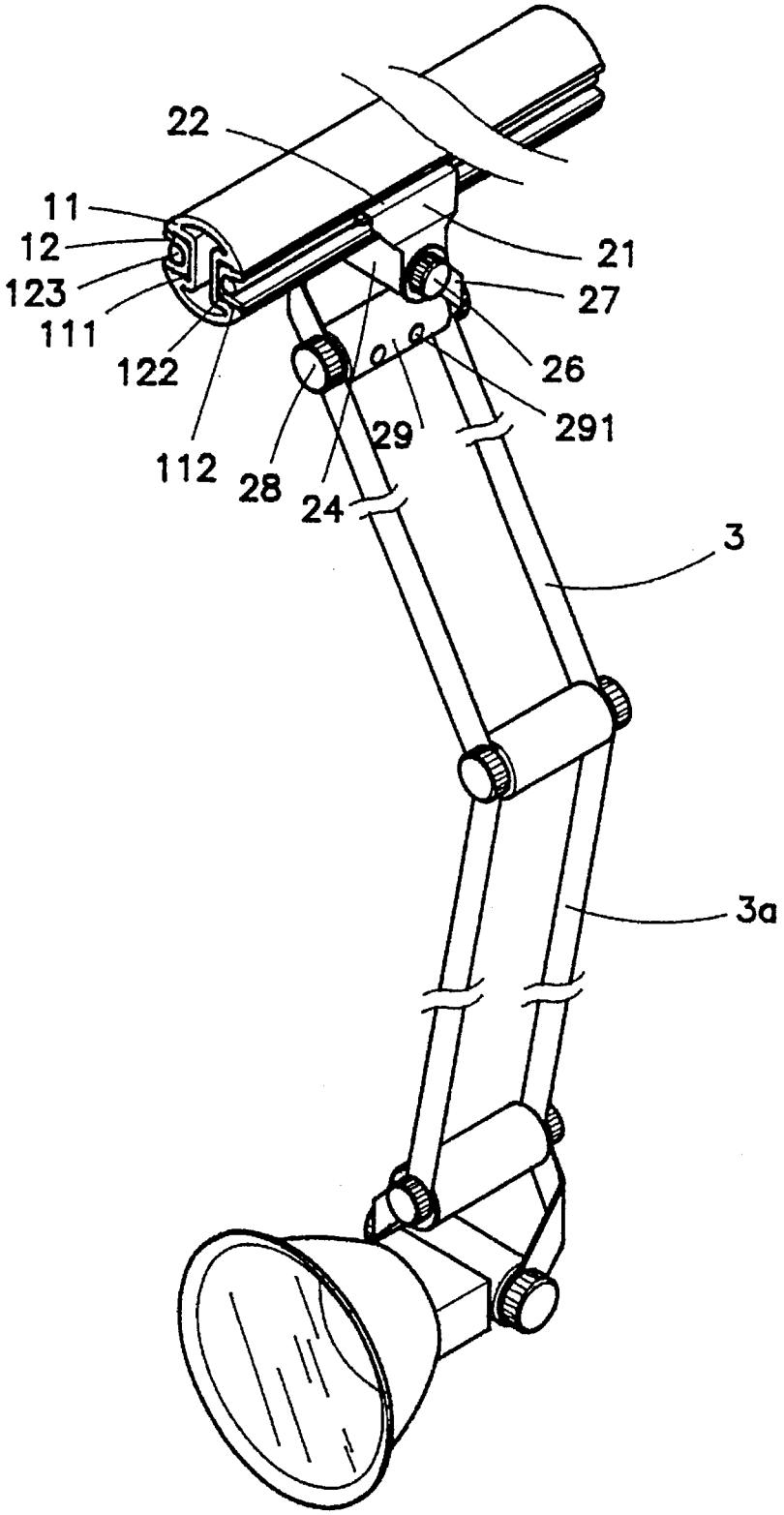
FIG. 7 is a schematic view of still another preferred embodiment of the invention.

Referring to FIG. 7, two extension bars 3*a* are further provided to have one of their ends connected to the extension bars 3 by means of a sleeve and a couple of screws. The extension bars 3*a* have the other of their sides connected to a clamping sleeve and bent connecting pieces and a second connecting sleeve with insert holes for mounting of a lamp. Likewise, a plurality of extension bars may be provided and connected in the above-mentioned manner to extend the length of the track light.

Although the present invention has been illustrated and described with reference to the preferred embodiment thereof, it should be understood that it is in no way limited to the details of such embodiment but is capable of numerous modifications within the scope of the appended claims.

What is claimed is:

1. A clamping and connecting structure for a track light, comprising:

a track unit consisting of a track having two grooves in both sides thereof, each of said grooves having raised strips at both a first and a second outer edge thereof, a couple of packing strips, each of said packing strips being fitted into each of said grooves and having a couple of retaining strips respectively formed at a first and a second side thereof to mate with said first and second outer edges, a retaining recess being defined within said packing strip for holding a lead wire;

a clamping unit consisting of a couple of clamping pieces each having a bent guide strip at an upper end thereof and a through hole in a lower portion thereof, a clamping sleeve having a plurality of seats with a plurality of lock holes respectively in opposite ends thereof, a couple of bent connecting pieces each having an upper through hole and a lower through hole, and a connecting sleeve having a plurality of locking holes, respectively, in opposite ends thereof and a plurality of insert holes in one side thereof, screws being passed through the upper through holes of said bent connecting pieces and the lower through holes of said clamping pieces into the lock holes of said clamping sleeve respectively to lock upper portions of said bent connecting pieces and said clamping pieces to said clamping sleeve, and screws being passed through the lower through holes of said bent connecting pieces and lock holes of said connecting sleeve respectively to lock lower portions of said bent connecting pieces to said connecting sleeve; and an extension bar unit, wherein each of said guide strips of said clamping pieces is arranged to be in contact with said lead wire in each retaining recess of said packing strip, and said extension bar unit connected to said connecting sleeve for mounting of a lamp.

2. A clamping and connecting structure as claimed in claim 1, wherein a lamp having insert means insertably mounted in said insert holes of said connecting sleeve of said clamping unit.

3. A clamping and connecting structure as claimed in claim 1, wherein said extension bar unit has one end thereof locked to said connecting sleeve by means of screws while another end thereof is connected to a second connecting sleeve with insert holes for mounting of a lamp via a clamping sleeve connected to a couple of bent connecting pieces and screws.

4. A clamping and connecting structure as claimed in claim 1, wherein said extension unit has one end thereof locked to said connecting sleeve by means of screws while another end thereof is connected to a second extension unit by means of a sleeve and screws, and said second extension unit is in turn connected to a second connecting sleeve with insert holes for mounting of a lamp via a clamping sleeve connected to a couple of bent connecting pieces and screws.

* * * * *